US005694687A

United States Patent [19]

Coleman

[11] Patent Number: 5,694,687

[45] Date of Patent: Dec. 9, 1997

[54] METHOD FOR PRODUCING A FABRICATED VEHICLE WHEEL

[75] Inventor: Alan W. Coleman, Southgate, Mich.

[73] Assignee: Hayes Wheels International, Inc., Romulus, Mich.

[21] Appl. No.: 553,212

[22] Filed: Nov. 7, 1995

[51] Int. Cl.[6] ..... B21K 1/28

[52] U.S. Cl. ..... 29/894.323; 29/894.325

[58] Field of Search ..... 29/894.323, 895.325, 29/894.324; 301/63.1

[56] References Cited

U.S. PATENT DOCUMENTS

| | | | |
|---|---|---|---|
| 2,133,144 | 10/1938 | Johnson | 29/894.325 |
| 4,280,426 | 7/1981 | Swan | 29/894.325 |
| 5,295,304 | 3/1994 | Ashley, Jr. . | |
| 5,345,676 | 9/1994 | Ashley, Jr. . | |

*Primary Examiner*—P. W. Echols
*Attorney, Agent, or Firm*—MacMillan, Sobanski & Todd

[57] ABSTRACT

An improved method for forming a vehicle wheel includes the steps of steps of: (a) providing a rim defining a rim axis and including a generally axially extending well portion and a pair of opposed ends, one of said ends including an inboard tire bead seat retaining flange and an inboard tire bead seat, and the other end including an outboard tire bead seat; (b) providing a generally circular disc blank formed from aluminum and defining a disc axis, the disc blank including an inner annular wheel mounting portion and an outer annular portion; (c) initially stamping the disc blank to produce a generally bowl shaped disc having a first axial distance defined between an inner surface of the outer annular portion and an inner surface of the inner annular wheel mounting portion; (d) subjecting the bowl shaped disc to an intermediate metal forming operation to produce a partially formed disc having a second axial distance defined between the inner surface of the outer annular portion and the inner surface of the inner annular wheel mounting portion; the second axial distance being less than the first axial distance; (e) subjecting the partially formed disc to a final metal forming to produce a finished disc having a predetermined disc profile; and (f) joining the finished disc to the rim to produce a fabricated vehicle wheel.

26 Claims, 12 Drawing Sheets

METHOD FOR PRODUCING A FABRICATED VEHICLE WHEEL

BACKGROUND OF THE INVENTION

This invention relates in general to vehicle wheels and in particular to an improved method for producing a fabricated vehicle wheel.

A conventional fabricated vehicle wheel is typically of a two-piece construction and includes an inner disc and an outer "full" rim. The disc can be cast, forged, or fabricated from steel, aluminum, or other alloys, and includes an inner annular wheel mounting portion and an outer annular portion. The wheel mounting portion defines an inboard mounting surface and includes a center pilot or hub hole, and a plurality of lug receiving holes formed therethrough for mounting the wheel to an axle of the vehicle. The rim is fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the disc is used. In both types of constructions, the outer annular portion of the disc is secured to the rim by welding.

A full face fabricated wheel is distinguished from other types of fabricated wheels by having a one-piece wheel disc construction. In particular, the full face wheel includes a "full face" disc and a "partial" rim. The full face disc can be formed cast, forged, or fabricated from steel, aluminum, or other alloys. The full face disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial rim is fabricated from steel, aluminum, or other alloys, and includes an inboard tire bead seat retaining flange, an inboard tire bead seat, an axially extending well, and an outboard tire bead seat. In some instances, the outboard tire bead seat of the rim and the outer annular portion of the disc cooperate to form the outboard tire bead seat retaining flange of the full face wheel. In both types of constructions, the outboard tire bead seat of the rim is positioned adjacent the outer annular portion of the disc and a weld is applied to secure the rim and the disc together.

FIG. 1 illustrates a block diagram showing a prior art sequence of steps for producing a full face fabricated steel vehicle wheel (not shown). Initially, in step 10, a flat sheet of steel material (not shown) is formed into a disc blank 30, shown in FIG. 2. The disc blank defines a generally uniform disc thickness T. Following this, the disc blank 30 is initially stamped in step 12 to produce a generally bowl shaped disc 32, shown in FIG. 3. The bowl-shaped disc 32 includes an outer annular portion 34 and an inner annular wheel mounting portion 36 having a "flattened" bottom. In particular, during the initial stamping operation of step 12, the disc blank 30 is stamped to define a first predetermined axial distance A defined between an inner surface 34A of the outer annular portion 34 and an inner surface 36A of the inner mounting portion 36.

The bowl-shaped disc 32 is then stamped into a partially-formed disc 38 having a predetermined profile, shown in FIG. 4, during step 14. Next, during step 16, a plurality of windows 40 (only one window illustrated in FIG. 5) are formed in the disc 38 to produce a partially-formed disc 42. Following this, the windows 40 are coined and an outer edge of the partially-formed disc 42 is trimmed to a predetermined diameter during step 18 to produce a partially-formed disc 44 shown in FIG. 6. Next, in step 20, a center hub hole 46 and a plurality of lug bolt mounting holes 48 (only one hole 48 is illustrated) are formed in the disc 44 to produce a partially-formed disc 50 shown in FIG. 7. Following this, the partially-formed disc 50 is restriked and then subjected to a final stamping operation during step 22 to produce a finished full face wheel disc 52 shown in FIG. 8. During step 22, a second predetermined axial distance B is defined between an inner surface 54A of an outer annular portion 54 of the disc 50, and an inner surface 56A of an inner mounting portion 56 of the disc 52. In the illustrated embodiment, the second predetermined axial distance B is less than the first predetermined axial distance A. Following this, the full face disc 52 is secured to a partial steel rim (not shown) during step 24 to produce the finished full face fabricated steel vehicle wheel.

SUMMARY OF THE INVENTION

For similarly sized aluminum and steel fabricated wheels, the thickness of an aluminum blank used to make an aluminum wheel disc is approximately one and three-quarters the thickness a steel blank used to make a steel wheel disc. Applicant has discovered that this increased thickness presents certain problems. For example, because of the volume of aluminum material which is needed to maintain strength in the high stress areas of the finished wheel disc, the initial stamping of the aluminum disc blank cannot follow the known steps discussed above in connection with the stamping of the steel disc blank.

The method for producing the fabricated vehicle wheel of the present invention includes the steps of: (a) providing a rim defining a rim axis and including a generally axially extending well portion and a pair of opposed ends, one of said ends including an inboard tire bead seat retaining flange and an inboard tire bead seat, and the other end including an outboard tire bead seat; (b) providing a generally circular disc blank formed from aluminum and defining a disc axis, the disc blank including an inner annular wheel mounting portion and an outer annular portion; (c) initially stamping the disc blank to produce a generally bowl shaped disc having a first axial distance defined between an inner surface of the outer annular portion and an inner surface of the inner annular wheel mounting portion; (d) subjecting the bowl shaped disc to an intermediate metal forming operation to produce a partially formed disc having a second axial distance defined between the inner surface of the outer annular portion and the inner surface of the inner annular wheel mounting portion; the second axial distance being less than the first axial distance; (e) subjecting the partially formed disc to a final metal forming to produce a finished disc having a predetermined disc profile; and (f) joining the finished disc to the rim to produce a fabricated vehicle wheel.

Other advantages of this invention will become apparent to those skilled in the art from the following detailed description of the preferred embodiment, when read in light of the accompanying drawings.

DESCRIPTION OF THE PREFERRED EMBODIMENT

Figure 1:
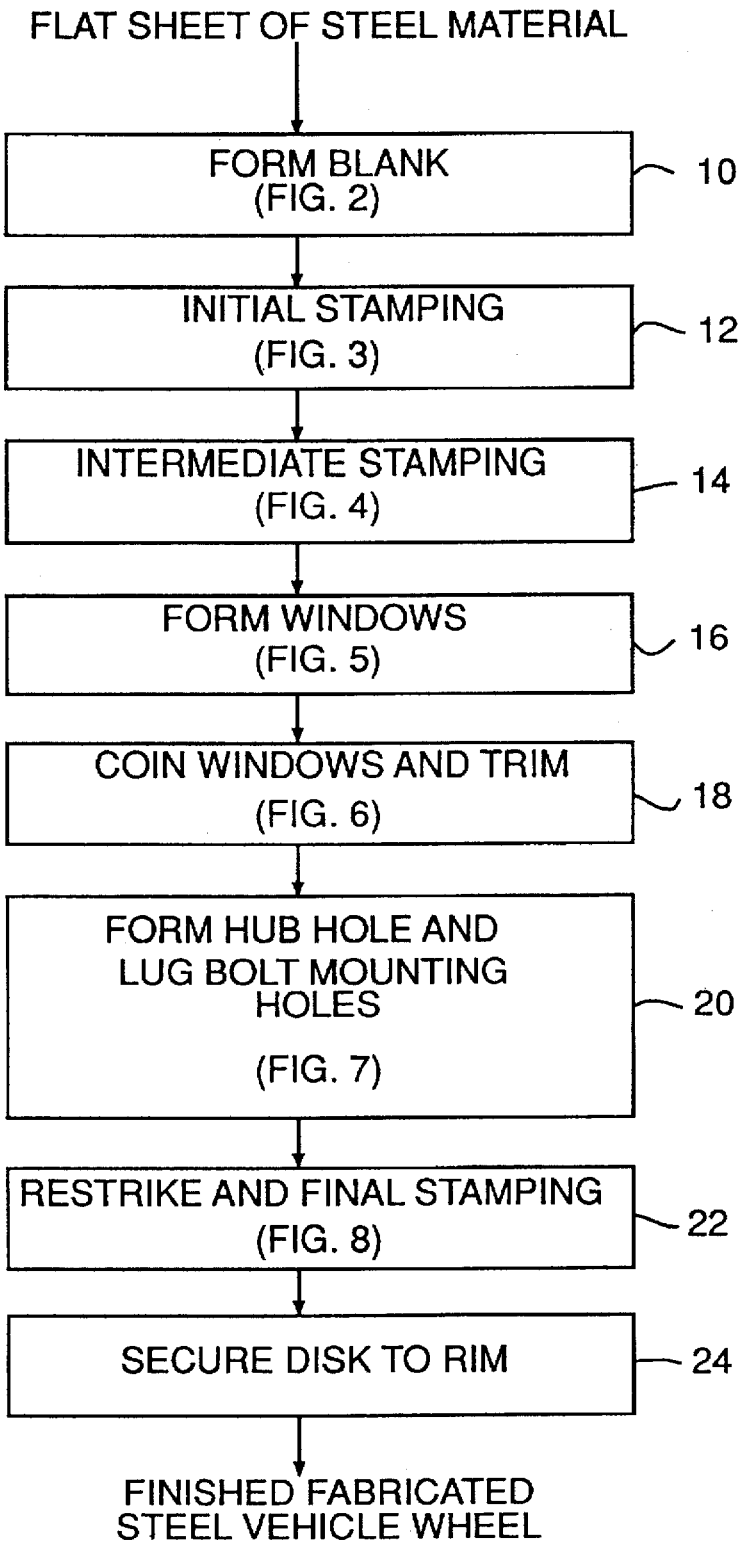
FIG. 1 (PRIOR ART)
FIG. 1 is a block diagram illustrating a prior art sequence of steps for producing a prior art fabricated steel vehicle wheel.
Figure 2:
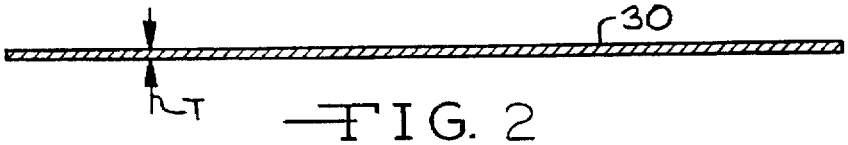
FIG. 2 PRIOR ART
FIG. 2 is a cross sectional view of a disc blank for use in producing the prior art fabricated steel vehicle wheel.
Figure 3:
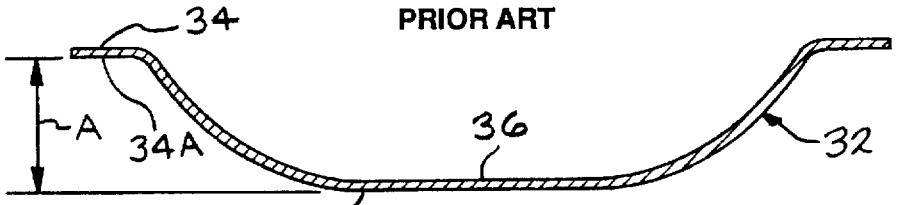
FIG. 3 PRIOR ART
FIG. 3 is a cross sectional view showing the initial stamping of the disc blank into a generally bowl shaped disc.
Figure 4:
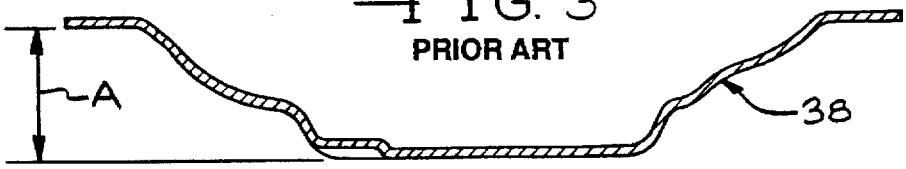
FIG. 4 PRIOR ART
FIG. 4 is a cross sectional view showing the intermediate stamping of the bowl shaped disc to produce a partially formed disc.
Figure 5:
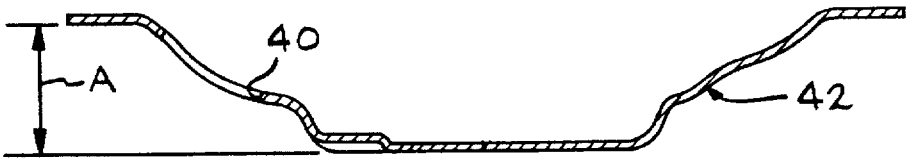
FIG. 5 PRIOR ART
FIG. 5 is a cross sectional view showing the forming of the windows in the partially formed disc.
Figure 6:
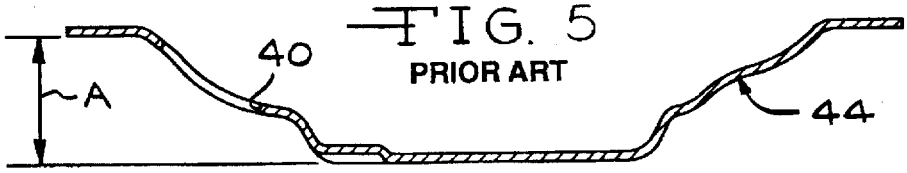
FIG. 6 PRIOR ART
FIG. 6 is a cross sectional view showing the trimming of the outer diameter of the partially formed disc.
Figure 7:
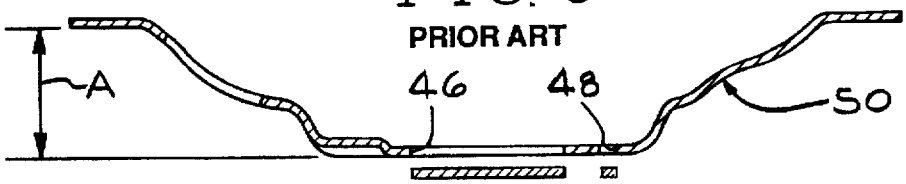
FIG. 7 PRIOR ART
FIG. 7 is a cross sectional view showing the forming of the hub hole and lug bolt mounting holes in the partially formed disc.
Figure 8:
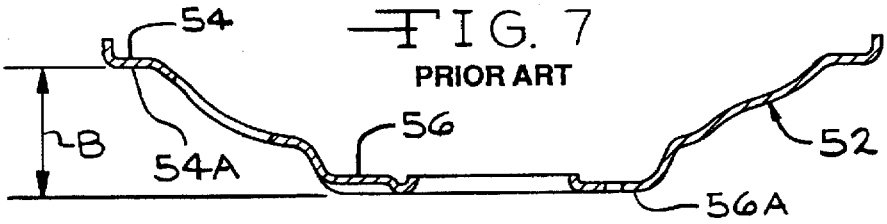
FIG. 8 PRIOR ART
FIG. 8 is a cross sectional view showing the final stamping of the partially formed disc to produce a finished steel wheel disc.
Figure 9:
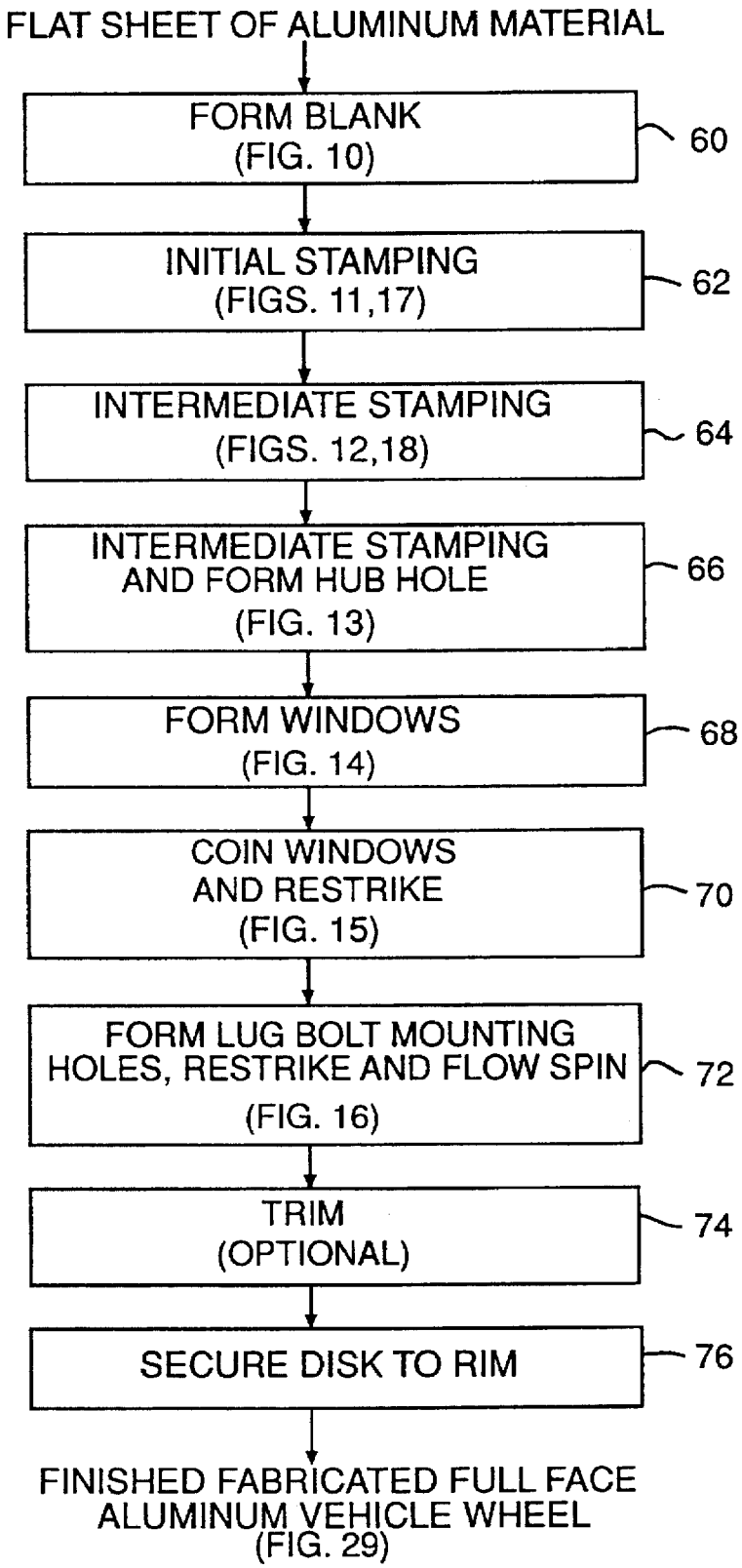
FIG. 9 is a block diagram illustrating a sequence of steps for producing a fabricated aluminum vehicle wheel in accordance with the present invention.

Referring now to the drawings, there is illustrated in FIG. 9 a block diagram showing a sequence of steps for producing a first embodiment of a fabricated vehicle wheel in accordance with the present invention. The vehicle wheel produced according to this sequence of steps is illustrated as being a full face fabricated aluminum vehicle wheel, indicated generally at 110 in FIG. 29. However, it will be appreciated that the present invention can be used in conjunction with other types of fabricated vehicle wheels having an aluminum wheel disc. For example, the vehicle wheel can be a "bead seat attached" wheel (such as shown in FIG. 4 of U.S. Pat. No. 5,188,429 to Heck et al.), a "well attached" wheel (such as shown in FIG. 3 of Heck et al.), a "bimetal" wheel construction including an aluminum disc and a steel rim (such as shown in U.S. Pat. No. 5,421,642 to Wei et al.), or a "modular wheel" construction including a "partial" rim and a full face wheel disc (such as shown in U.S. Pat. No. 5,360,261 to Archibald et al.), all of these patents incorporated herein by reference.

Figure 10:
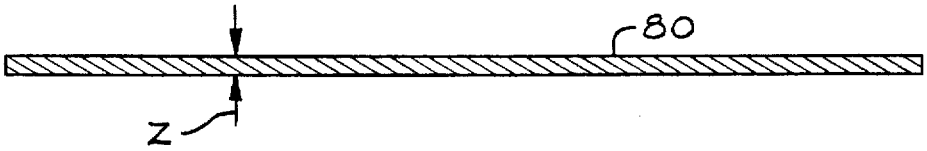
FIG. 10 is a cross sectional view of the disc blank for use in producing the fabricated aluminum vehicle wheel of the present invention.
Figure 11:
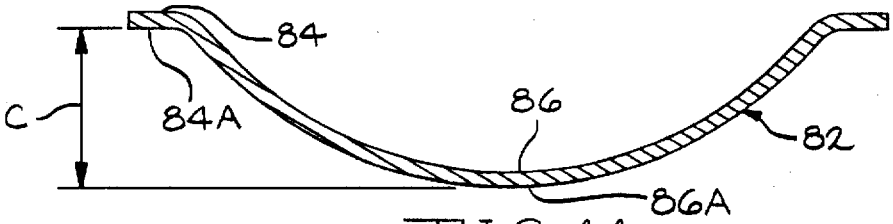
FIG. 11 is a cross sectional view showing the initial stamping of the disc blank into a generally salad bowl shaped disc.
Figure 17:
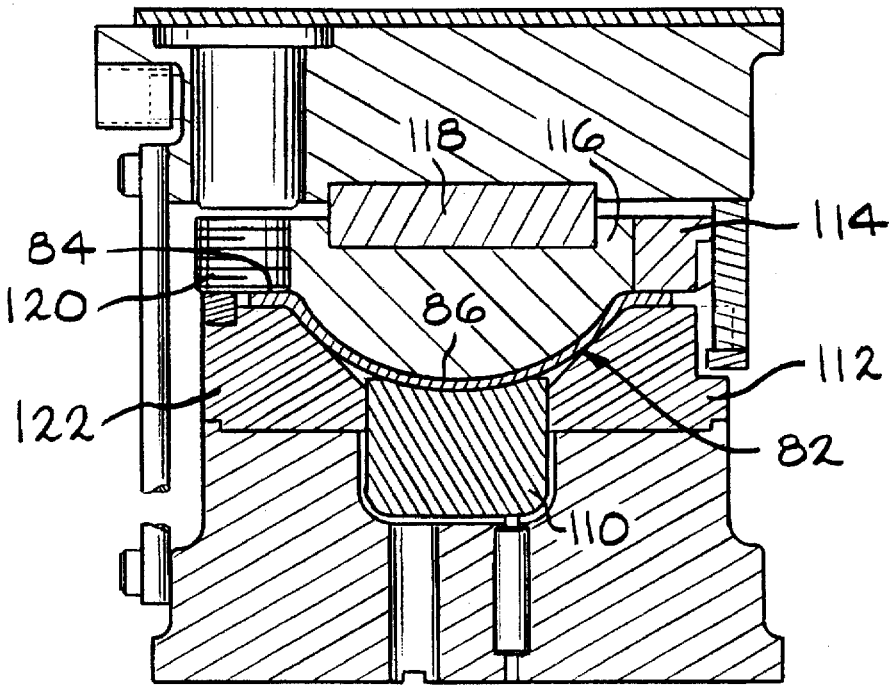
FIG. 17 is a partial sectional view showing the generally salad bowl shaped disc prior to the intermediate stamping operation.

Turning to FIG. 9, the sequence of steps for producing the vehicle wheel 100 of the present invention will be discussed. Initially, in step 60, a flat sheet of aluminum material (not shown) is formed into a disc blank 80, shown in FIG. 10. The disc blank 80 defines a generally uniform disc thickness Z. Following this, the disc blank 80 is initially stamped in step 62 to produce a generally "salad" bowl-shaped disc 82, shown in FIGS. 11 and 17. The salad bowl-shaped disc 82 includes an outer annular portion 84 and an inner annular portion 86. In particular, during the initial stamping operation of step 62, the disc blank 80 engaged by a plurality of dies, seven dies 110, 112, 114, 116, 118, 120 and 122 being illustrated in FIG. 17. During step 62, a first predetermined axial distance C is defined between an inner surface 84A of the outer annular portion 84 and an inner surface 86A of the inner annular portion 86. As will be discussed below, it is important to form the disc 82 with a deeper generally non-flattened shaped bowl, compared to the shape of the bowl when using steel, as shown in FIG. 3, so that after performing subsequent metal forming steps, the finished disc meets predetermined strength requirements.

Figure 12:
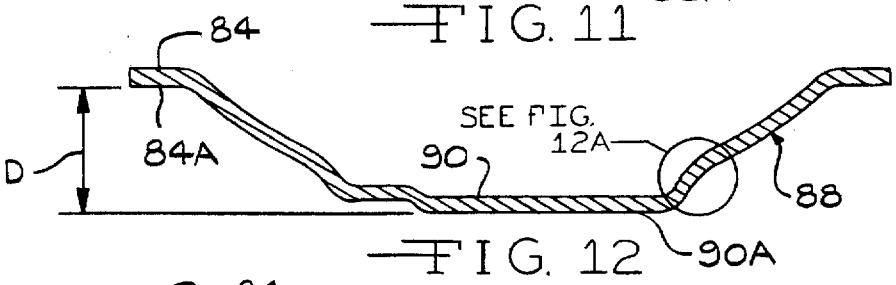
FIG. 12 is a cross sectional view showing the intermediate stamping of the salad bowl shaped disc to produce a partially formed disc.
Figure 12A:
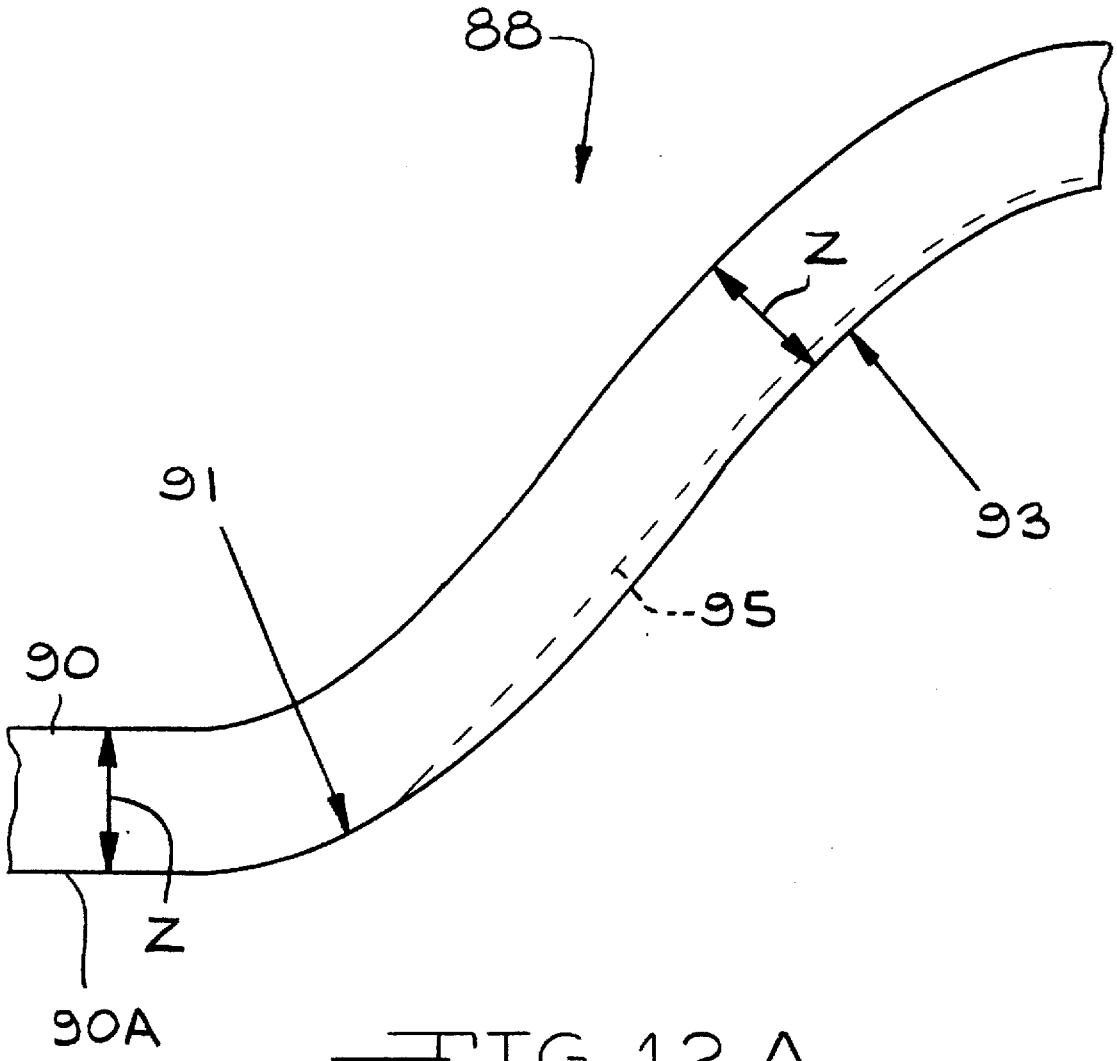
FIG. 12A is an enlarged view of a portion of the partially formed disc illustrated in FIG. 12.
Figure 18:
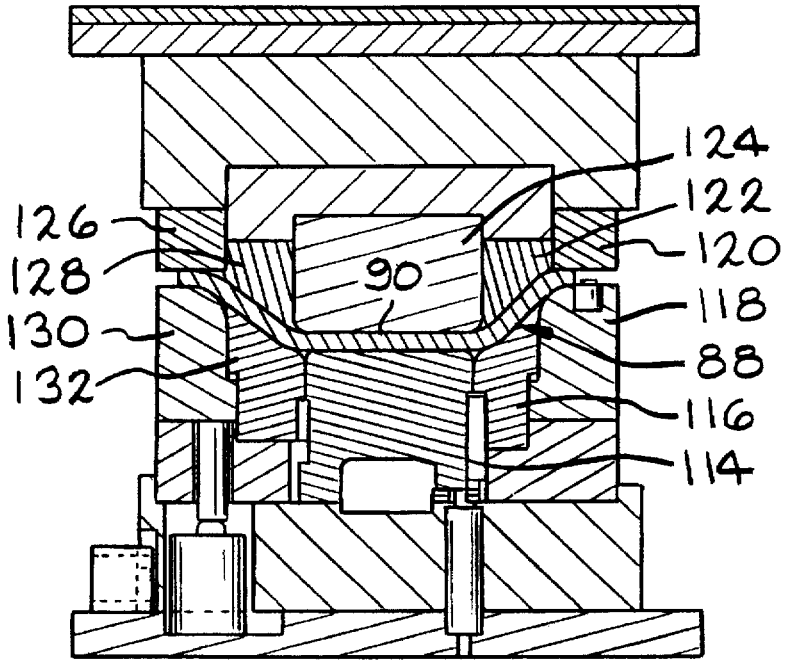
FIG. 18 is a partial sectional view showing the partially formed disc after the intermediate stamping operation.

The salad bowl-shaped disc 82 is then stamped into a partially-formed disc 88 having a predetermined profile, as shown in FIGS. 12 and 18, during step 64. In particular, during step 64, the salad bowl-shaped disc 82 is engaged by a plurality of dies, ten dies 114, 116, 118, 120, 122, 124, 126, 128, 130, and 132 being illustrated in FIG. 18. The partially-formed disc 88 includes an inner annular wheel mounting portion 90 defining a flattened bottom. As best shown in FIG. 12A, the partially-formed disc 88 includes a mounting pad radius, indicated by arrow 91, and a hat radius, indicated by arrow 93. During step 64, a generally constant thickness Z is generally maintained throughout the entire length of the disc 88 and, in particular, in the area of the hat radius 93. A slight thinning of the material occurs in the area of the pad radius 91.

Also, during step 64, a predetermined second axial distance D is defined between the inner surface 84A of the outer annular portion 84 and an inner surface 90A of the inner annular wheel mounting portion 90. As illustrated, the second predetermined axial distance D is less than the first predetermined axial distance C. Alternatively, during step 62, a slight flattening of the inner annular portion 86 can occur. However, as will be discussed below, it is not possible to flatten the inner annular portion 86 of the aluminum blank 80 to the shape shown in FIG. 3 when using a steel blank 30.

Figure 13:
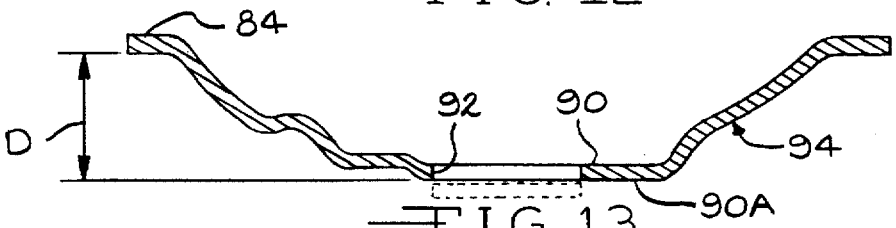
FIG. 13 is a cross sectional view showing the intermediate stamping and the forming of the hub hole in the partially formed disc.
Figure 14:
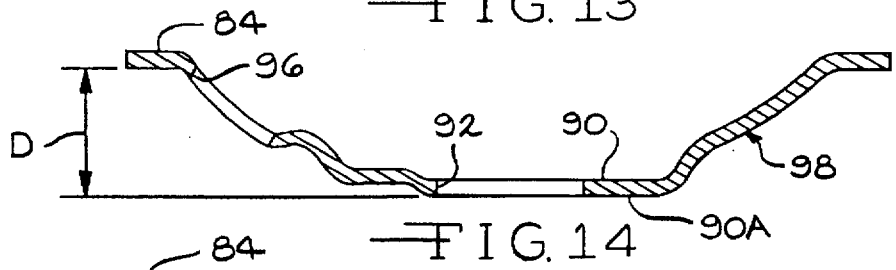
FIG. 14 is a cross sectional view showing the forming of the windows in the partially formed disc.
Figure 15:
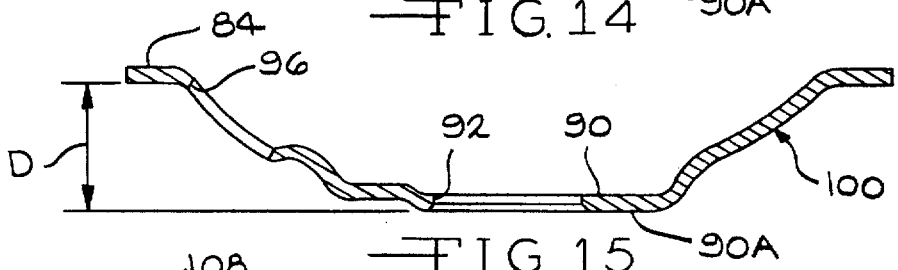
FIG. 15 is a cross sectional view showing the coming of the back side of the windows and the restriking of the hub hole in the partially formed disc.

Next, during step 66, the disc 88 is subjected to a further stamping operation and a center hub hole 92 is formed in the disc 88 to produce a partially-formed disc 94 shown in FIG. 13. Following this, a plurality of windows 96 (only one window is illustrated in FIG. 14) are formed in the partially-formed disc 94 during step 68 to produce a partially formed disc 98. In step 70, the windows 96 are coined and the disc 98 is restriked to produce a partially formed disc 100 shown in FIG. 15.

Figure 16:
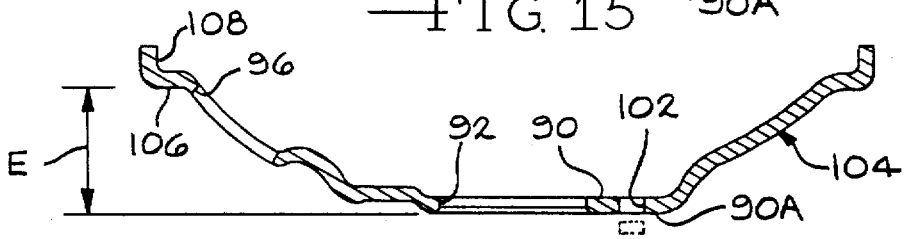
FIG. 16 is a cross sectional view showing the forming of the lug bolt receiving holes and the sizing and coming of the back side of the hub hole to produce a finished full face aluminum wheel disc.

Next, in step 72, a plurality of lug bolt mounting holes 102 (only one hole 102 is illustrated in FIG. 16) are formed in the disc 100, the disc 100 is restriked, and then preferably subjected to a final flow spinning operation to produce a finished full face aluminum wheel disc 104 shown in FIG. 16. In particular, during the restriking operation of step 72, a predetermined third axial distance E is defined between the inner surface 84A of the outer annular portion 84 of the disc 104, and the inner surface 90A of the inner mounting portion 90 of the disc 104. In the illustrated embodiment, the predetermined third axial distance E is less than the predetermined second axial distance D. During flow spinning step 72, a slight thinning of the material may occur (not shown). The disc 104 includes a generally radially outwardly extending outer annular end portion 106 which defines the outboard tire bead seat retaining flange of the full face wheel 110.

Next, in optional step 74, an outer end portion 108 of the outboard tire bead seat retaining flange 106 is subjected to a trimming operation to provide a smooth tire flange radius. Alternatively, the disc 104 may be subjected to a final stamping operation in step 72 instead of the flow spinning operation. When the disc 104 is subjected to a final stamping operation in step 72, the trimming operation of optional step 74 is usually performed.

Figure 29:
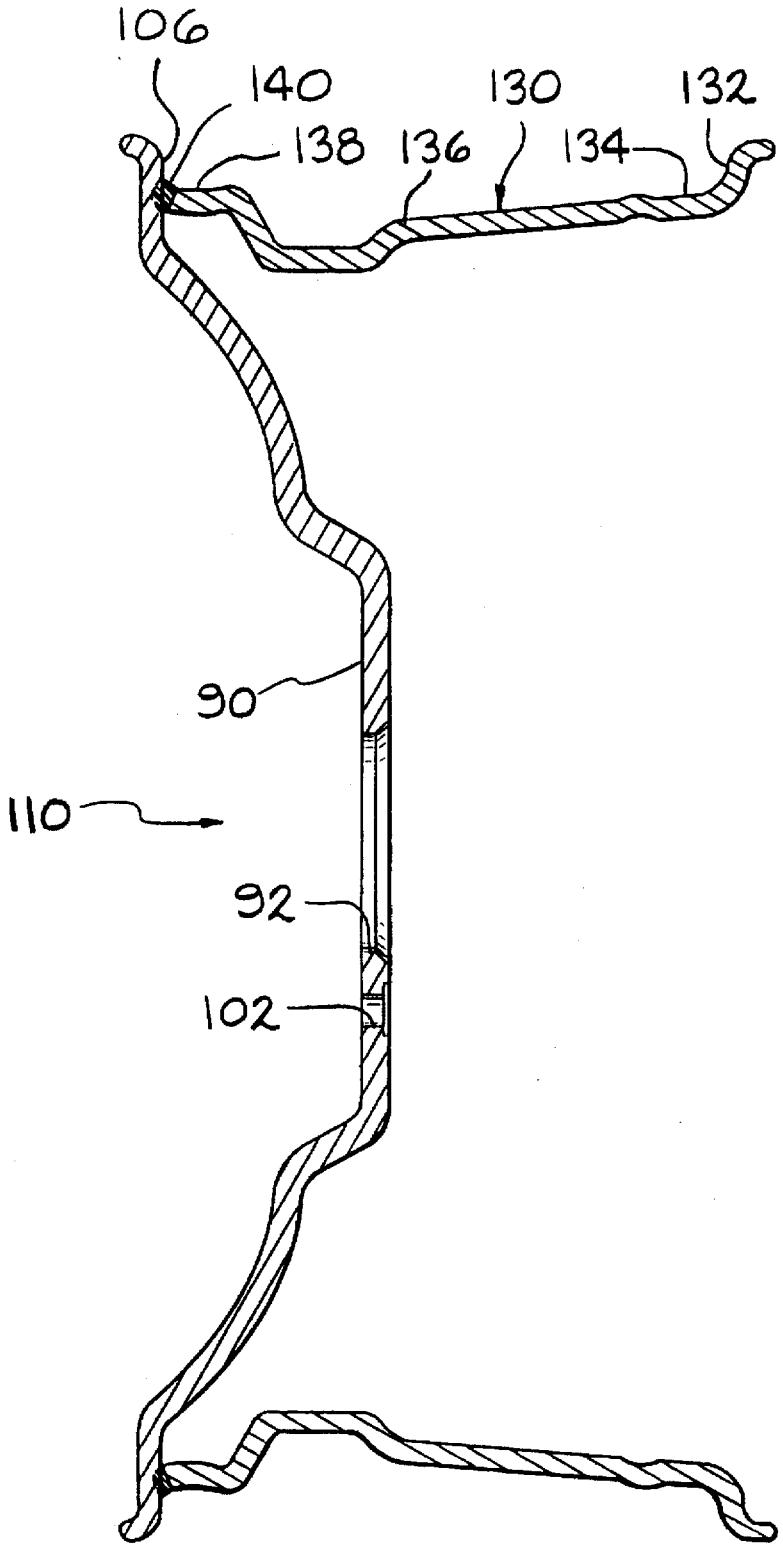
FIG. 29 is a sectional view of a full face fabricated aluminum wheel produced in accordance with the present invention.

Following this, the finished full face aluminum disc 104 is secured to a partial aluminum rim 130, shown in FIG. 29, having a predetermined shape in step 76. As shown therein, the rim 130 includes an inboard tire bead seat retaining flange 132, an inboard tire bead seat 134, a generally axially extending well 136, and an outboard tire bead seat 138. In particular, during step 76, the outboard tire bead seat 138 of the rim 130 is positioned adjacent the outboard tire bead seat retaining flange 106 of the disc 104, and a circumferentially extending continuous, air-tight weld 140 is applied to secure the rim 130 and disc 104 together to produce the finished full face fabricated aluminum vehicle wheel 110.

Figure 19:
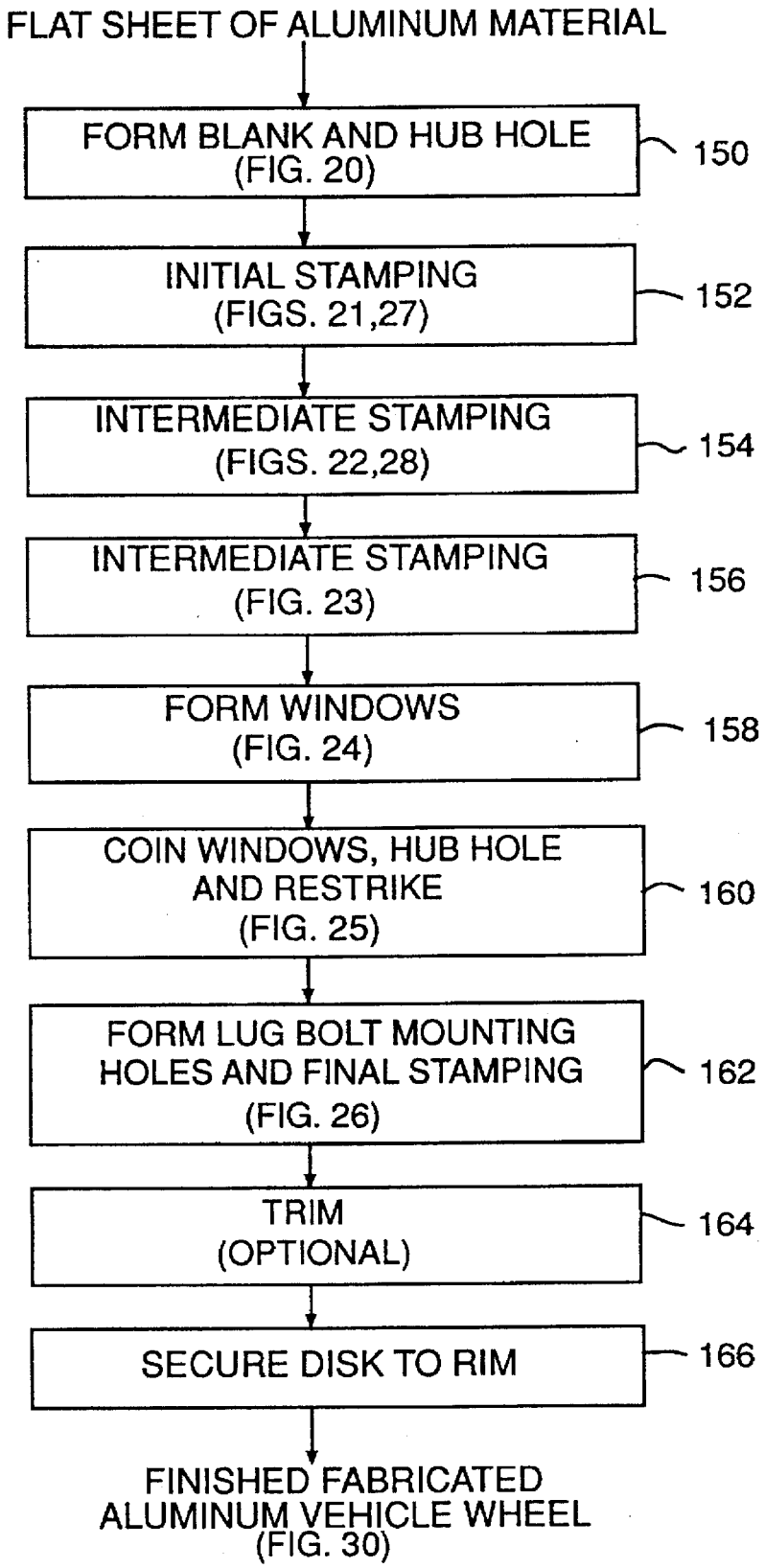
FIG. 19 is a block diagram illustrating another sequence of steps for producing a fabricated aluminum vehicle wheel in accordance with the present invention.
Figure 20:
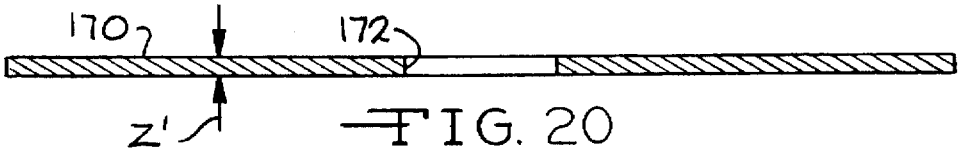
FIG. 20 is a cross sectional view of the disc blank for use in producing the fabricated aluminum vehicle wheel of the present invention.
Figure 21:
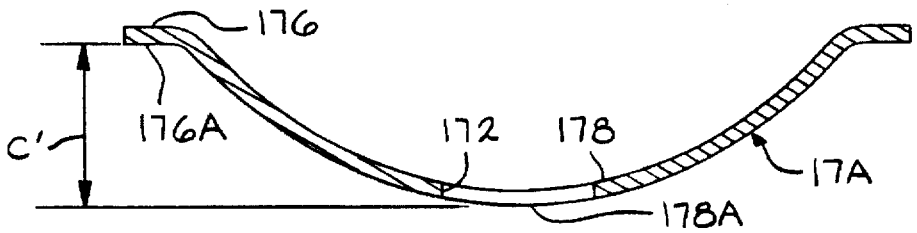
FIG. 21 is a cross sectional view showing the initial stamping of the disc blank into a generally salad bowl shaped disc.
Figure 27:
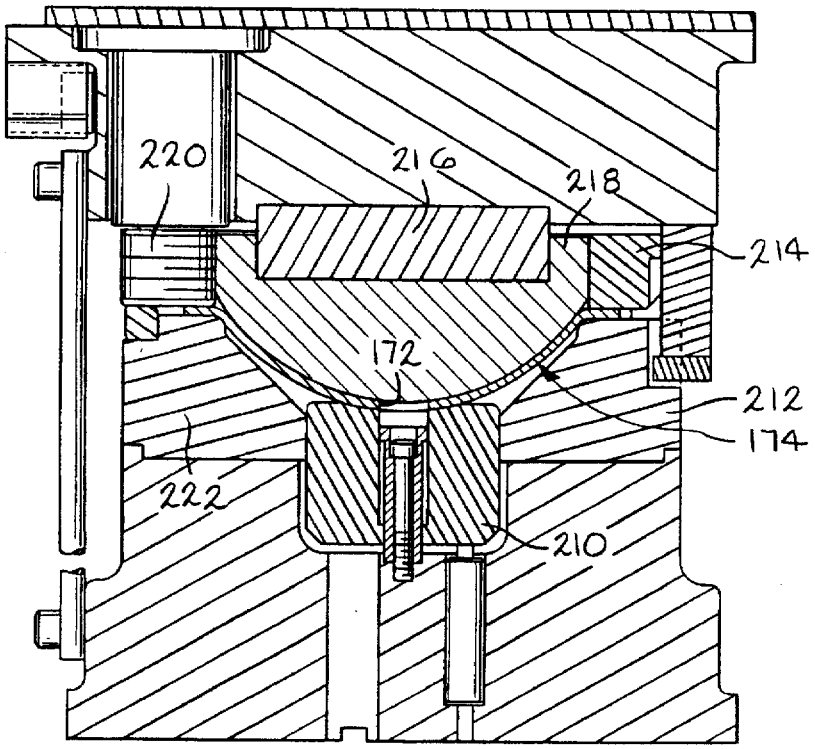
FIG. 27 is a partial sectional view showing the generally salad bowl shaped disc prior to the intermediate stamping operation.

Turning now to FIG. 19, a sequence of steps for producing a second embodiment of a fabricated vehicle wheel, indicated generally at 200 in FIG. 30 as being a bead seat attached wheel, of the present invention will be discussed. Initially, in step 150, a flat sheet of aluminum material (not shown) is formed into a disc blank 170 and a center hub hole 172 is formed therein, as shown in FIG. 20. The disc blank 170 defines a generally uniform disc thickness Z'. Following this, the disc blank 170 is initially stamped in step 152 to produce a generally salad bowl-shaped disc 174, shown in FIGS. 21 and 27. The salad bowl-shaped disc 174 includes an outer annular portion 176 and an inner annular portion 178 having a non-flattened bottom. In particular, during the initial stamping operation of step 152, the disc blank 170 engaged by a plurality of dies, seven dies 210, 212, 214, 216, 218, 220 and 222 being illustrated in FIG. 27. During step 152, a first predetermined axial distance C' defined between an inner surface 176A of the outer annular portion 176 and an inner surface 178A of the inner annular portion 178. As will be discussed below, it is important to form the disc 174 with a deeper generally non-flattened shaped bowl, compared to the shape of the bowl when using steel as shown in FIG. 3, so that after performing subsequent metal forming steps, the finished disc meets predetermined strength requirements.

Figure 22:
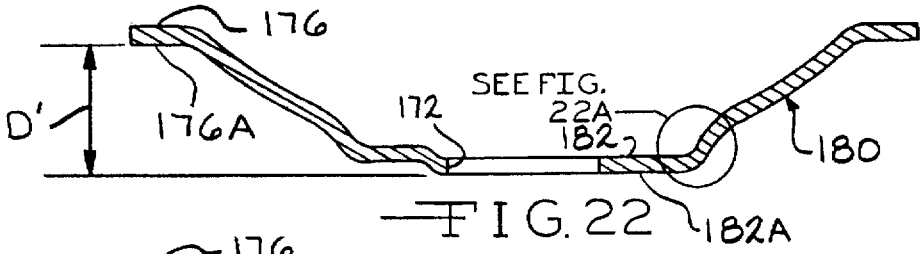
FIG. 22 is a cross sectional view showing the intermediate stamping of the salad bowl shaped disc to produce a partially formed disc.
Figure 22A:
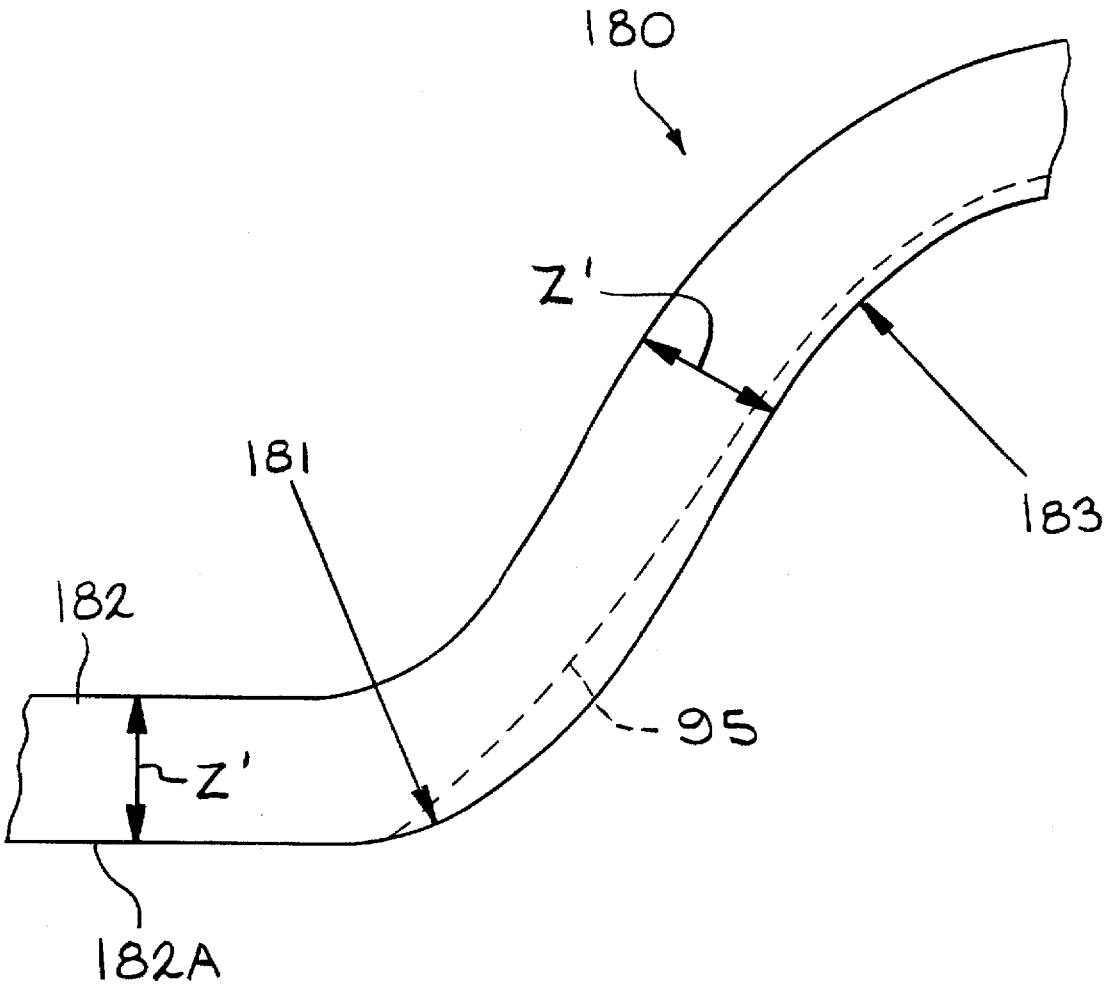
FIG. 22A is an enlarged view of a portion of the partially formed disc illustrated in FIG. 22.
Figure 28:
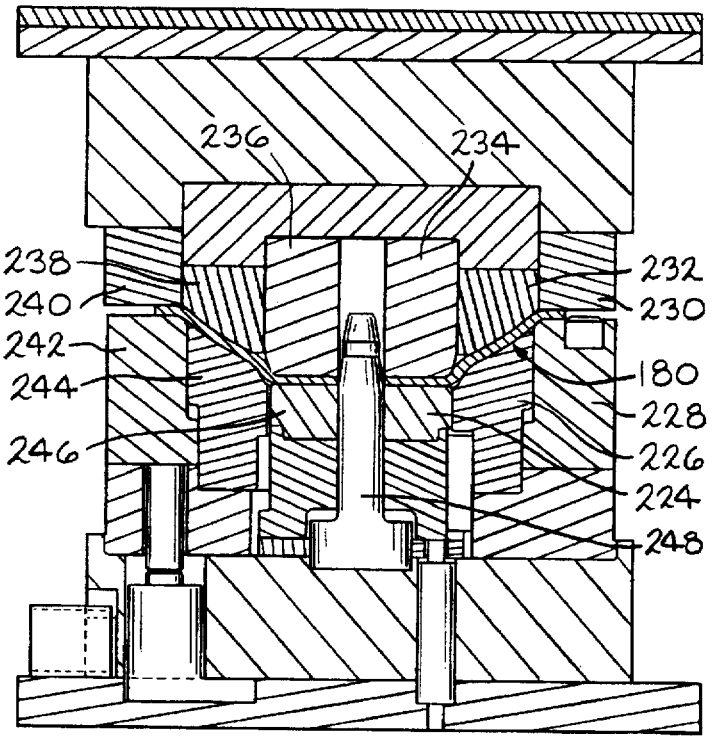
FIG. 28 is a partial sectional view showing the partially formed disc after the intermediate stamping operation.

The salad bowl-shaped disc 174 is then stamped into a partially-formed disc 180 having a predetermined profile, as shown in FIG. 22, during step 154. In particular, during step 154, the salad bowl-shaped disc 174 is engaged by a plurality of dies, twelve dies 224, 226, 228, 230, 232, 234, 236, 238, 240, and 242 illustrated in FIG. 28, and a center "extruding" post 248. The partially-formed disc 180 includes an inner annular wheel mounting portion 182. As best shown in FIG. 22A, the partially-formed disc 180 includes a mounting pad radius, indicated by arrow 181, and a hat radius, indicated by arrow 183. During step 154, a generally constant thickness Z' is maintained throughout the entire length of the disc 180 and, in particular, in the area of the hat radius 183.

Figure 23:
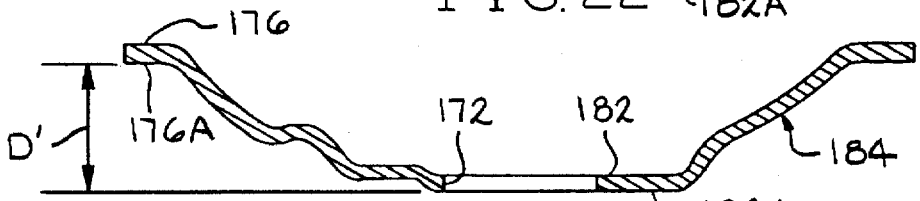
FIG. 23 is a cross sectional view showing the intermediate stamping and the forming of the hub hole in the partially formed disc.

Also, during step 154, a predetermined second axial distance D' is defined between the inner surface 176A of the outer annular portion 176 and an inner surface 182A of the inner annular wheel mounting portion 182. As illustrated, the second predetermined axial distance D' is less than the first predetermined axial distance C'. Following this, the partially-formed disc 180 is subjected to one or more stamping operations to produce a disc 184 having a predetermined profile, as shown in FIG. 23.

Figure 24:
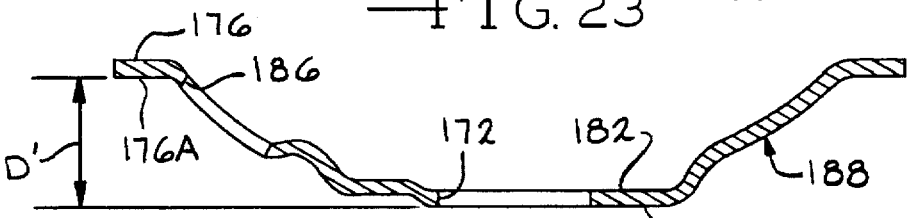
FIG. 24 is a cross sectional view showing the forming of the windows in the partially formed disc.
Figure 25:
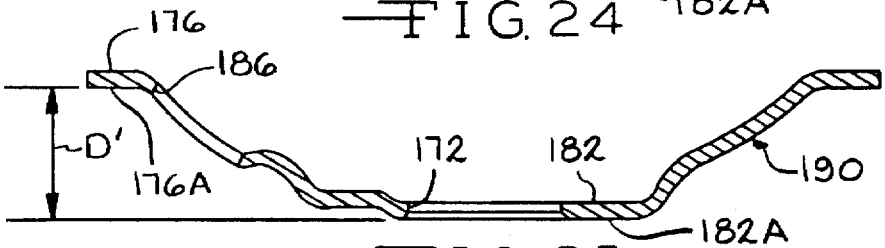
FIG. 25 is a cross sectional view showing the coining of the back side of the windows and the restriking of the hub hole in the partially formed disc.

Next, during step 158, a plurality of windows 186 (only one window 186 is illustrated in FIG. 24 ) are formed in the disc 184 to produce a partially formed disc 188. In step 160, the windows 186 and hub hole 172 are coined and the disc 188 is restriked to produce a partially formed disc 190 shown in FIG. 25.

Figure 26:
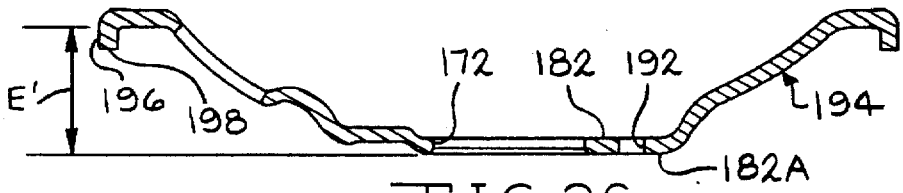
FIG. 26 is a cross sectional view showing the forming of the lug bolt receiving holes and the sizing and coining of the back side of the hub hole to produce a finished full face aluminum wheel disc.

Next, in step 162, a plurality of lug bolt mounting holes 192 (only one lug bolt mounting hole 192 is illustrated in FIG. 16) are formed in the disc 190, and then the disc 190 is subjected to a final stamping operation to produce a finished conventional aluminum wheel disc 194 shown in FIG. 26. In particular, during step 162, a predetermined third axial distance E' is defined between the inner surface 176A of the outer annular portion 176 of the disc 194, and the inner surface 182A of the inner mounting portion 182 of the disc 194. In the illustrated embodiment, the predetermined third axial distance E' is less than the predetermined second axial distance D'. The disc 194 includes a generally radially inwardly extending outer annular end portion 196.

In optional step 164, an outer end portion 198 of the outer annular end portion 196 is subjected to a trimming operation to provide a smooth tire flange radius. Alternatively, the disc 190 may be subjected to a final flow spinning operation in step 162 instead of the stamping operation. When the disc 190 is subjected to a final flow spinning operation in step 162, the trimming operation of optional step 164 is usually not performed.

Figure 30:
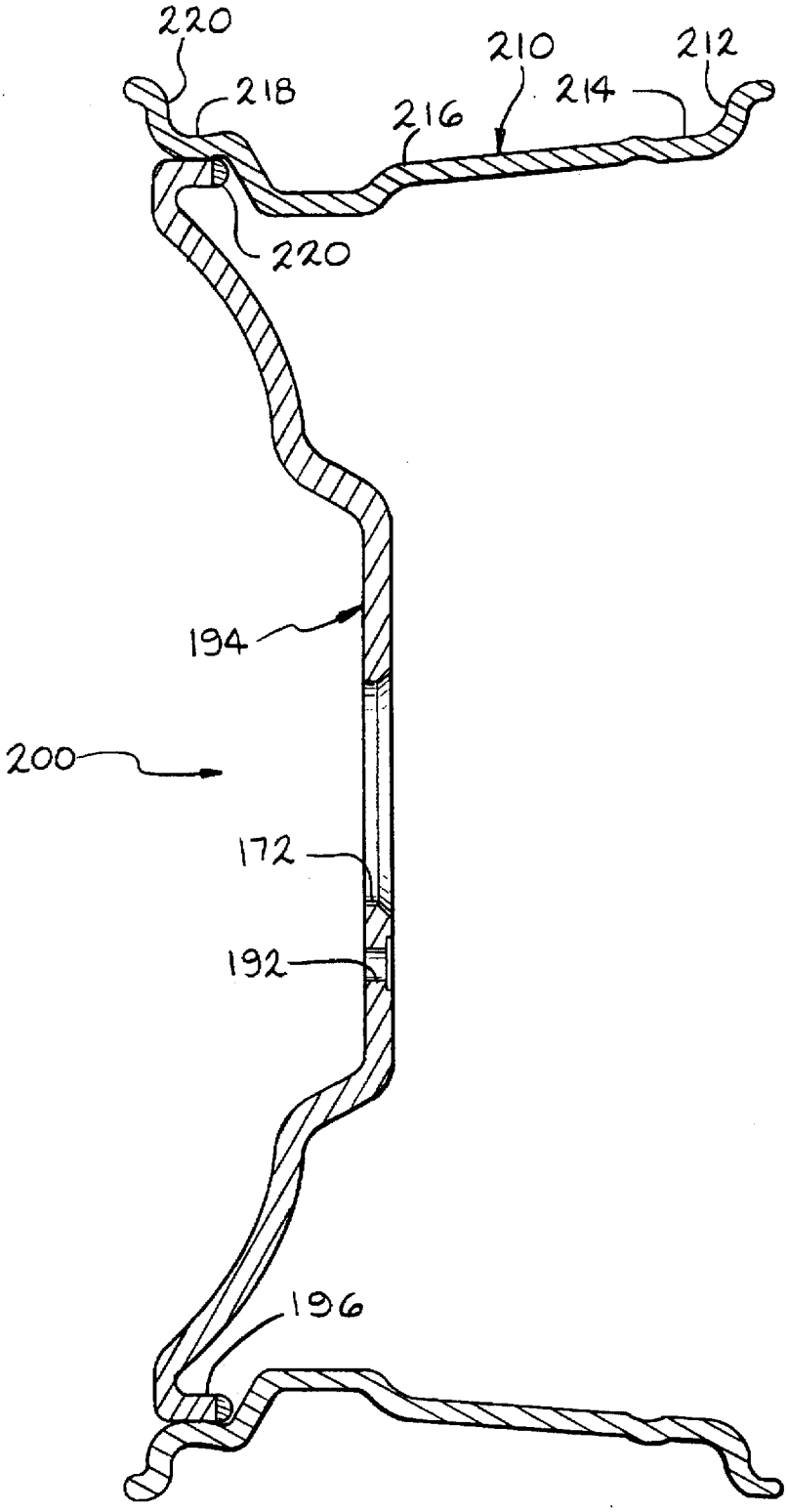
FIG. 30 is a sectional view of a conventional bead seat attached fabricated aluminum wheel produced in accordance with the present invention.

Following this, the aluminum disc 194 is secured to a partial aluminum rim 210, shown in FIG. 30, having a predetermined shape in step 166. As shown therein, the rim 210 includes an inboard tire bead seat retaining flange 212, an inboard tire bead seat 214, a generally axially extending well 216, an outboard tire bead seat 218, and an outboard tire bead retaining flange 220. In particular, during step 166, the outer annular portion 196 of the disc 194 is positioned adjacent an inner surface of the outboard tire bead seat 218 of the rim 210, and a circumferentially extending continuous, air-tight weld 220 is applied to secure the rim 210 and disc 194 together to produce the finished bead seat attached aluminum vehicle wheel 200.

As discussed above, for use in a similar sized wheel, the increased thickness of the aluminum disc blank 80 and 170 compared to that of the steel disc blank 30 presents certain problems. For example, the thickness of the aluminum disc blank is approximately 0.35 inches compared to a steel disc blank 30 having a thickness of approximately 0.20 inches. Because of this, during the initial stamping of the aluminum disc blank 80 and 170 in step 62 and 152, respectively, it is not possible to form the aluminum blank into the bowl shape of the steel blank shown in FIG. 3. As a result, it is necessary to "drape" the aluminum material and form a much deeper bowl shaped disc 82 and 174 during step 62 and 152, respectively, compared to that when using steel to form the bowl shaped disc 32 shown in FIG. 3. In particular, during the initial stamping operation, the distance C of the aluminum disc 82 and 172 is approximately 3.750 inches, whereas the distance A of the steel disc 32 is approximately 3.0 inches. As a result, the thickness of the aluminum material remains generally constant and sufficient material remains in the high stress area of the disc. In particular, as shown in FIGS. 12A and 22A, the thickness Z and Z' of the aluminum material in the area of the hat radius 93 and 183 of the disc 88 and 180, respectively, remains generally constant.

Also, due to the increased thickness of the aluminum disc blank 80 and 170 compared to that of the steel disc blank 30, the aluminum blank cannot be flattened out like the steel blank in FIG. 3. If it is attempted to flatten out the aluminum blank to the shape shown in FIG. 3 and then perform the initial stamping operation, the aluminum material tends to thin in the areas of the pad and hat radius, as shown in phantom in FIGS. 12A and 22A at 95. As a result, during subsequent metal forming operations, this thinning can produce cracks in the aluminum material.

Also, when the aluminum disc blank 170 includes a hub hole 172 formed therein, it is important to prevent the material from flowing toward the center of the disc and closing the hub hole during steps 154 and 156 in order that sufficient material remains in the hat area of the disc. In the illustrated embodiment, this is accomplished by using an extruding post 248.

In accordance with the provisions of the patents statues, the principle and mode of operation of this invention have been described and illustrated in its preferred embodiment. However, it must be understood that the invention may be practiced otherwise than as specifically explained and illustrated without departing from the scope or spirit of the attached claims.

What is claimed is:

1. A method for forming a fabricated vehicle wheel comprising the steps of:

(a) providing a rim defining a rim axis and including a generally axially extending well portion and a pair of opposed ends, one of said ends including an inboard tire bead seat retaining flange and an inboard tire bead seat, and the other end including an outboard tire bead seat;

(b) providing a generally circular disc blank formed from aluminum and defining a disc axis, the disc blank including an inner annular wheel mounting portion and an outer annular portion;

(c) initially stamping the disc blank to produce a generally bowl shaped disc having a first axial distance defined between an inner surface of the outer annular portion and an inner surface of the inner annular wheel mounting portion;

(d) subjecting the bowl shaped disc to an intermediate metal forming operation to produce a partially formed disc having a second axial distance defined between the inner surface of the outer annular portion and the inner surface of the inner annular wheel mounting portion, the second axial distance being less than the first axial distance;

(e) subjecting the partially formed disc to a final metal forming operation to produce a finished disc having a predetermined disc profile; and (f) joining the finished disc to the rim to produce a fabricated vehicle wheel.

2. The method defined in claim 1 wherein the inner wheel mounting portion of the generally bowl-shaped disc of step (c) defines a mounting pad radius and a hat radius, and step (d) includes subjecting the bowl-shaped disc to an intermediate metal forming operation to produce a partially formed disc having a generally constant thickness in the mounting pad radius and the hat radius of the partially formed disc.

3. The method defined in claim 1 wherein step (d) includes forming a center hub hole in the partially formed disc.

4. The method defined in claim 3 wherein step (d) includes forming a plurality of windows in the partially-formed disc.

5. The method defined in claim 4 wherein step (d) includes coining the windows of the partially formed disc.

6. The method defined in claim 5 wherein step (d) includes restriking the partially formed disc.

7. The method defined in claim 6 wherein step (d) includes forming a plurality of lug bolt mounting holes in the partially formed disc.

8. The method defined in claim 7 wherein step (e) includes subjecting the partially formed disc to a final flow spinning operation to produce the finished disc.

9. The method defined in claim 7 wherein step (e) includes subjecting the partially formed disc to a final stamping operation to produce the finished disc.

10. The method defined in claim 7 wherein step (e) includes restriking the partially formed disc to form a predetermined third axial distance between the inner surface of the outer annular portion of the partially formed disc and the inner surface of the inner mounting portion of the partially formed disc which is less than the predetermined second axial distance of step (d).

11. The method defined in claim 1 wherein the rim of step (a) is formed from aluminum.

12. The method defined in claim 1 wherein the disc of step (e) is a full face wheel disc, and the wheel of step (f) is a full face fabricated vehicle wheel.

13. The method defined in claim 1 wherein the rim of step (a) includes an outboard tire bead seat retaining flange, and the wheel of step (f) is a bead seat attached vehicle wheel.

14. The method defined in claim 1 wherein the rim of step (a) includes an outboard tire bead seat retaining flange, and the wheel of step (f) is a well attached vehicle wheel.

15. A method for forming a fabricated vehicle wheel comprising the steps of:

(a) providing a rim defining a rim axis and including a generally axially extending well portion and a pair of opposed ends, one of said ends including an inboard tire bead seat retaining flange and an inboard tire bead seat, and the other end including an outboard tire bead seat;

(b) providing a generally circular disc blank formed from aluminum and defining a disc axis, the disc blank including an inner annular wheel mounting portion and an outer annular portion;

(c) initially stamping the disc blank to produce a generally bowl shaped disc, the bowl shaped disc defining a mounting pad radius and a hat radius in the area of the inner annular wheel mounting portion thereof, the inner annular wheel mounting portion of the bowl-shaped disc having a generally non-flattened bottom;

(d) subjecting the bowl shaped disc to an intermediate metal forming operation to produce a partially formed disc having a generally constant thickness in the mounting pad radius and the hat radius thereof, the inner wheel mounting portion of the partially formed disc having a generally flattened bottom;

(e) subjecting the partially formed disc to a final metal forming to produce a finished disc having a predetermined disc profile; and (f) joining the finished disc to the rim to produce a fabricated vehicle wheel.

16. The method defined in claim 15 wherein step (d) includes forming a center hub hole in the partially formed disc.

17. The method defined in claim 16 wherein step (d) includes forming a plurality of windows in the partially-formed disc.

18. The method defined in claim 17 wherein step (d) includes coining the windows of the partially formed disc.

19. The method defined in claim 18 wherein step (d) includes restriking the partially formed disc.

20. The method defined in claim 19 wherein step (d) includes forming a plurality of lug bolt mounting holes in the partially formed disc.

21. The method defined in claim 20 wherein step (e) includes subjecting the partially formed disc to a final flow spinning operation to produce the finished disc.

22. The method defined in claim 20 wherein step (e) includes subjecting the partially formed disc to a final stamping operation to produce the finished disc.

23. The method defined in claim 15 wherein the rim of step (a) is formed from aluminum.

24. The method defined in claim 15 wherein the disc of step (e) is a full face wheel disc, and the wheel of step (f) is a full face fabricated vehicle wheel.

25. The method defined in claim 15 wherein the rim of step (a) includes an outboard tire bead seat retaining flange, and the wheel of step (f) is a bead seat attached vehicle wheel.

26. The method defined in claim 15 wherein the rim of step (a) includes an outboard tire bead seat retaining flange, and the wheel of step (f) is a well attached vehicle wheel.

* * * * *